US007454937B2

(12) United States Patent
Patzelt et al.

(10) Patent No.: US 7,454,937 B2
(45) Date of Patent: Nov. 25, 2008

(54) EXPANDABLE AND CONTRACTIBLE COILER MANDREL

(75) Inventors: Ulrich Patzelt, Hilchenbach (DE); Franz Nosolik, Siegen (DE)

(73) Assignee: SMS Demag AG, 40237 Düsseldorf (DE)

( * ) Notice: Subject to any disclaimer, the term of this patent is extended or adjusted under 35 U.S.C. 154(b) by 18 days.

(21) Appl. No.: 11/578,812

(22) PCT Filed: Mar. 29, 2006

(86) PCT No.: PCT/EP2006/002845

§ 371 (c)(1),
(2), (4) Date: Oct. 19, 2006

(87) PCT Pub. No.: WO2006/103051

PCT Pub. Date: Oct. 5, 2006

(65) Prior Publication Data

US 2007/0220940 A1 Sep. 27, 2007

(30) Foreign Application Priority Data

Mar. 30, 2005 (DE) ..... 10 2005 014 874

(51) Int. Cl.
*B21C 47/00* (2006.01)

(52) U.S. Cl. ..... 72/148; 72/43

(58) Field of Classification Search ..... 72/146, 72/148, 41, 43, 44, 45
See application file for complete search history.

(56) References Cited

U.S. PATENT DOCUMENTS 2,578,953 A 12/1951 Tyrrell
3,754,720 A * 8/1973 Gross et al. ..... 242/573.7
4,213,577 A 7/1980 Majoor
5,524,465 A * 6/1996 Kajiwara et al. ..... 72/42

FOREIGN PATENT DOCUMENTS

| | | |
|---|---|---|
| DE | 20 32 542 | 1/1971 |
| DE | 103 47 262 | 10/2004 |
| EP | 0 722 791 | 7/1996 |
| WO | 2004/037456 | 5/2004 |

OTHER PUBLICATIONS

Patent Abstracts of Japan, BD. 005, No. 029, (M-056), Feb. 21, 1981 & JP 55 156149 A (Hitachi Ltd), Dec. 4, 1980.

* cited by examiner

*Primary Examiner*—Derris H. Banks
*Assistant Examiner*—Debra M Wolfe
(74) *Attorney, Agent, or Firm*—Friedrich Kueffner

(57) ABSTRACT

An expandable and contractible coiler mandrel for coiling metal strip, including: a rotatably supported coiler mandrel shaft with a wedge surface on its outer circumference; cooperating segments, which have an outer circumference with a coiling surface for the strip, and which have an opposing wedge surface cooperating with the wedge surface of the mandrel shaft in their end region facing away from the coiling surface; a mechanism for shifting the segments relative to an axial direction of the mandrel shaft; and a supply system for conveying lubricant to coiler mandrel regions that require lubrication. The supply system is connected with a lubricant pump having an actuating element for pumping, such that the pump is connected with the shifting mechanism or with the mandrel shaft, and the actuating element is connected with the other of the mandrel shaft or the shifting mechanism whereby pumping occurs only when the shifting mechanism is actuated.

11 Claims, 3 Drawing Sheets

EXPANDABLE AND CONTRACTIBLE COILER MANDREL

BACKGROUND OF THE INVENTION

The invention concerns an expandable and contractible coiler mandrel, especially for coiling a metal strip, which has: a rotatably supported coiler mandrel shaft, which has at least one wedge surface on its outer circumference; a number of cooperating segments, which have a coiling surface, especially for the metal strip, on their outer circumference, and which have at least one opposing wedge surface that cooperates with the wedge surface of the coiler mandrel shaft in their end region facing away from the coiling surface; means for shifting the segments relative to the axial direction of the coiler mandrel shaft; and a supply system with which a lubricant, especially lubricating grease, is conveyed to places in the coiler mandrel that require lubrication.

Coiler mandrels of this type are needed, for example, in the production of steel strip. The strip is coiled or uncoiled on them, for example, to carry out further processing steps on the strip. To allow the strip to be coiled or uncoiled on the mandrel without slipping, the coiler mandrel can be expanded and contracted. That is, the diameter of the mandrel coiling surface provided for coiling the strip can be varied. In other words, the coiler mandrel is spread, for example, during the coiling operation, to create a nonpositive connection between the mandrel and the metal strip.

In this regard, stable and reproducible operation of the coiler mandrel requires that it be supplied with lubricant, especially lubricating grease. Only then can the operating characteristics of the mandrel be maintained at a constant level over time. In addition, this is the only way to prevent wear.

Various well-known techniques can be used for lubricating the coiler mandrel:

First, the lubrication can be performed manually at predetermined intervals of time by means of grease nipples. A sufficient amount of grease must be applied to last until the next greasing. This can result in overlubrication with unacceptable levels of escaping grease, which is found to be a problem especially because centrifugal action in the coiler mandrel often causes grease loss.

Another possibility for lubricating a coiler mandrel with a free shaft end, usually at the drive end, is lubrication with a rotary distributor from a stationary grease pump. The grease is carried to the coiler mandrel in this way. In this regard, grease can be permanently supplied as part of a central lubrication system, which can be provided especially in the case of a hot coiler.

In the case of coiler mandrels made of high-grade steel, the grease connection is often automatically produced at the service end of the shaft via the mandrel support bearing during a shutdown by means of an attachable medium coupling, and the lubrication is carried out in this way. During the operation of the coiler mandrel, the grease connection is then detached.

Permanently acting lubricant distributors are also known, but they frequently fail to apply the grease pressure necessary to ensure good supply of all lubricating points.

EP 0 722 791 B1 discloses a lubricating device for an expandable coiler mandrel in which all of the lubricating points on the mandrel shaft can be centrally lubricated. In this device, cartridges that communicate with the lubricating points to be supplied with lubricant are inserted in a central bore of the mandrel shaft. In addition, there is a connection to a central grease distributor, which supplies the bores in the cartridge with grease.

DE-OS 20 32 542 also discloses the supplying of lubricant to lubricating points of a coiler mandrel by means of a grease supply system integrated in the mandrel, wherein this system is connected to the feed line of a pressure medium source. The lubricant is fed to the coiler mandrel by a line of this type and a distributor element.

Similar solutions are disclosed by U.S. Pat. Nos. 2,578,953 and 4,213,577.

A disadvantage of the previously known solutions is that too much or too little lubricant is often fed to the coiler mandrel and especially to its lubricating points. In this regard, both insufficient lubrication and excessive lubrication are associated with important disadvantages. In the case of insufficient lubrication, erosion of surfaces that slide on each other in the coiler mandrel can occur. Excessive lubrication not only results in higher costs than necessary, but also can cause environmental pollution, which must then be dealt with at considerable expense.

The stated problem is further intensified by the fact that centrifugal forces in the coiler mandrel can cause the lubricant to be flung away from the point at which it is needed.

In other solutions, handling is associated with significant disadvantages when, specifically, media systems must be attached to the coiler mandrel at certain intervals of time to supply lubricating grease.

SUMMARY OF THE INVENTION

Therefore, the objective of the invention is to improve a coiler mandrel of the aforementioned type in such a way that the specified disadvantages are avoided. This is intended to achieve improved lubrication of the mandrel to obtain economic and ecological advantages.

In accordance with the invention, the solution to this problem is characterized by the fact that the supply system is connected with a lubricant pump, which has an actuating element for carrying out the pumping operation, such that the lubricant pump is connected with the means for shifting the segments or with the coiler mandrel shaft, and the actuating element is connected with the other of the two elements in such a way that when the means for shifting the segments are actuated, the pumping operation is carried out.

The invention is thus based on the idea that the lubricant pump is activated only during the axial shifting movement for expanding or contracting the coiler mandrel, and lubrication of the points that need lubrication occurs only then. In this regard, the actuation of the lubricant pump is derived from the shifting movement in the coiler mandrel, so that external control, movement, or supply for the purpose of lubrication are unnecessary.

A first improvement provides that the lubricant pump is connected with a lubricant reservoir, which can be refilled or replaced at relatively large intervals of time, as required. In addition, the lubricant pump can be installed inside the lubricant reservoir. Furthermore, it is advantageous for the lubricant reservoir to be installed in the axial end region of the coiler mandrel.

In order to provide reliable supply of lubricant to lubricating points located at any given distance from the lubricant pump, the lubricant pump is preferably capable of applying a lubricating pressure of at least 150 bars.

The actuating element can be designed as a pin aligned in the axial direction of the coiler mandrel.

The means for shifting the segments relative to the coiler mandrel shaft can have a connecting rod arranged in a central bore of the coiler mandrel shaft and a pressure plate connected with the connecting rod. In this case, it is advantageous to provide that the pin-shaped actuating element penetrates at least the axial end region of the pressure plate and rests against an axial end of the coiler mandrel shaft. In this case, the lubricant pump (installed in the lubricant reservoir) is then rigidly mounted on the pressure plate; the actuating element of the lubricant pump passes through an axially aligned bore in the pressure plate and rests against the axial end of the coiler mandrel shaft. The lubricant pump is actuated during the axial shift between the coiler mandrel shaft and the pressure plate, and only then.

In accordance with another improvement, at least one lubricant distributor, which is installed in the supply system between the lubricant pump and the point to be lubricated, distributes the lubricant in different supply lines to different points to be lubricated. A first lubricant distributor preferably distributes the lubricant from the lubricant pump to each segment, and in each segment a second lubricant distributor is installed, which conveys the lubricant to each of the contact points of wedge surfaces and opposing wedge surfaces.

It is especially advantageous to install the lubricant pump, together with the actuating element and the lubricant reservoir, in the coiler mandrel as a retrofitted unit. This makes it possible to retrofit existing coiler mandrel systems with regard to the solution proposed in accordance with the invention.

The proposal of the invention is characterized by the fact that it makes it possible, in a very simple and thus inexpensive way, to reliably supply a plurality of lubricating points, for example, more than 20, with lubricant with relatively long grease supply distances without the need for complicated equipment. The necessary grease pressure can be developed without difficulty in order to reliably overcome even relatively long conveying distances.

In accordance with the proposal of the invention, lubricant is delivered only when it is actually needed. If the coiler mandrel is neither expanded nor contracted, no lubrication occurs, since lubrication is not needed in these operating states. The lubrication system is activated only when an expansion or a contraction occurs. This provides permanent lubrication when needed, i.e., at every working stroke of the mandrel. A minimum amount of lubrication over a long period of time is thus possible. The coiler mandrel thus automatically supplies itself with grease according to the frequency of movement of the mandrel. The sliding surfaces of the moving parts of the mandrel thus always have a sufficient supply of lubricant. This ensures an approximately constant coefficient of friction, which is especially advantageous during the operation. In other words, the kinetic resistance during expansion or contraction of the mandrel undergoes hardly any change during the operating time.

The grease reservoir that is provided independently supplies the lubricating points, so that it is not necessary to connect the coiler mandrel to external media supply systems. This significantly reduces the amount of manual work. In addition, connection to an otherwise required power supply (electric current) becomes unnecessary. The grease reservoir can be refilled or replaced at relatively lengthy intervals of time.

Since the lubrication is carried out only when the mandrel moves, there is also no need for monitoring, for example, by a monitoring device.

All together, the costs for operating the coiler mandrel are reduced, and monitoring devices, e.g., for pressure monitoring or limit switch positions during the attachment of supply systems, become redundant. Automation of the lubrication is possible in a simple way.

BRIEF DESCRIPTION OF THE DRAWING

The drawings illustrate a specific embodiment of the invention.

DETAILED DESCRIPTION OF THE INVENTION

Figure 3:
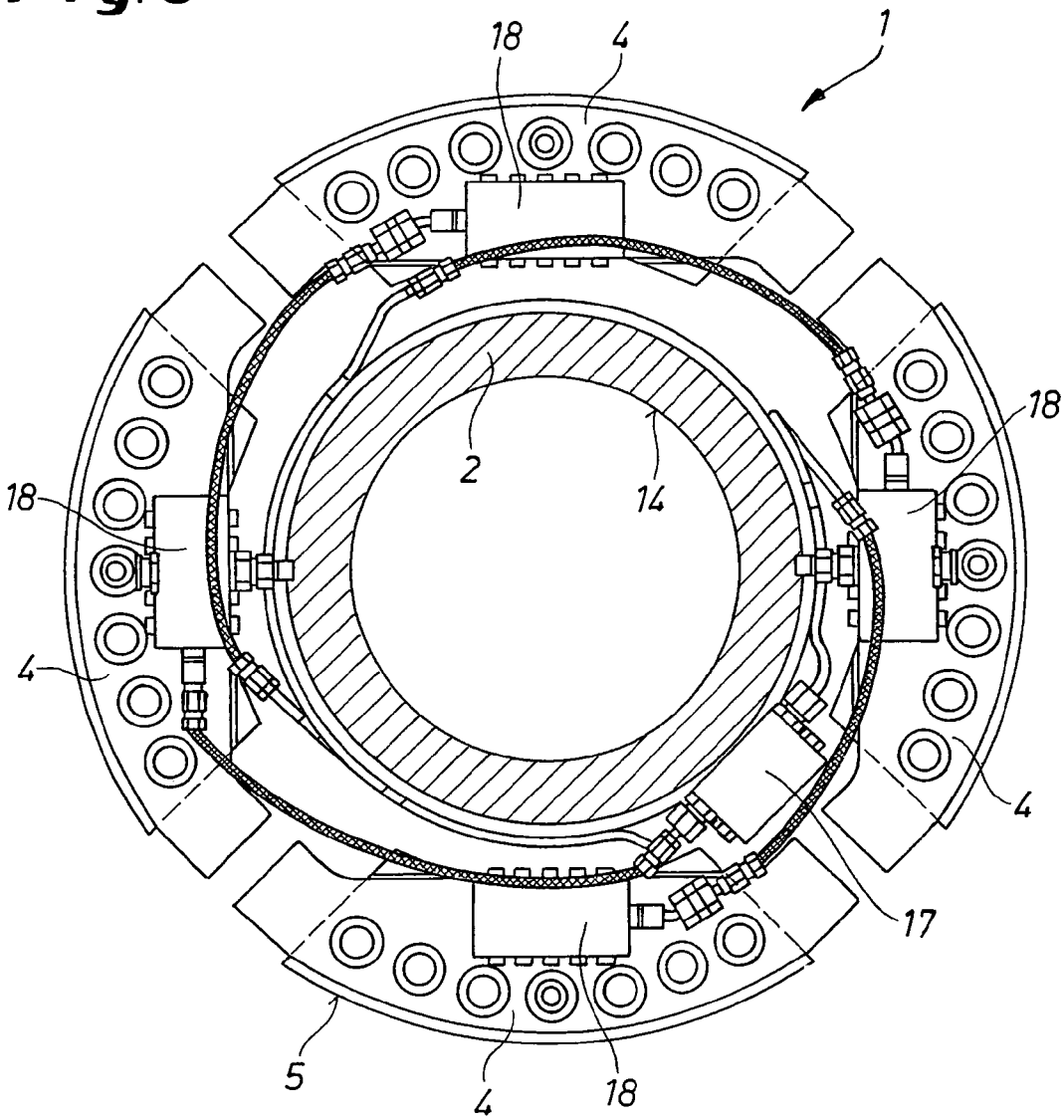
FIG. 3 shows a front view of the coiler mandrel (viewed in axial direction A).

The drawings show a coiler mandrel 1, which can be expanded or contracted with respect to its coiling surface. The coiler mandrel 1 has a coiler mandrel shaft 2, which is provided with a number of wedge surfaces 3 in the axial direction A. In the specific embodiment illustrated here, the coiler mandrel shaft 2 is surrounded by four segments 4 (see especially FIG. 3), each of which forms about one fourth of a circular ring. Each of the segments 4 has a coiling surface 5 on its radial outer surface for coiling a metal strip. The end region 6 of each region 4 that faces away from this coiling surface 5 has an opposing wedge surface 7, which has the same wedge angle as the wedge surface 3.

Figure 1:
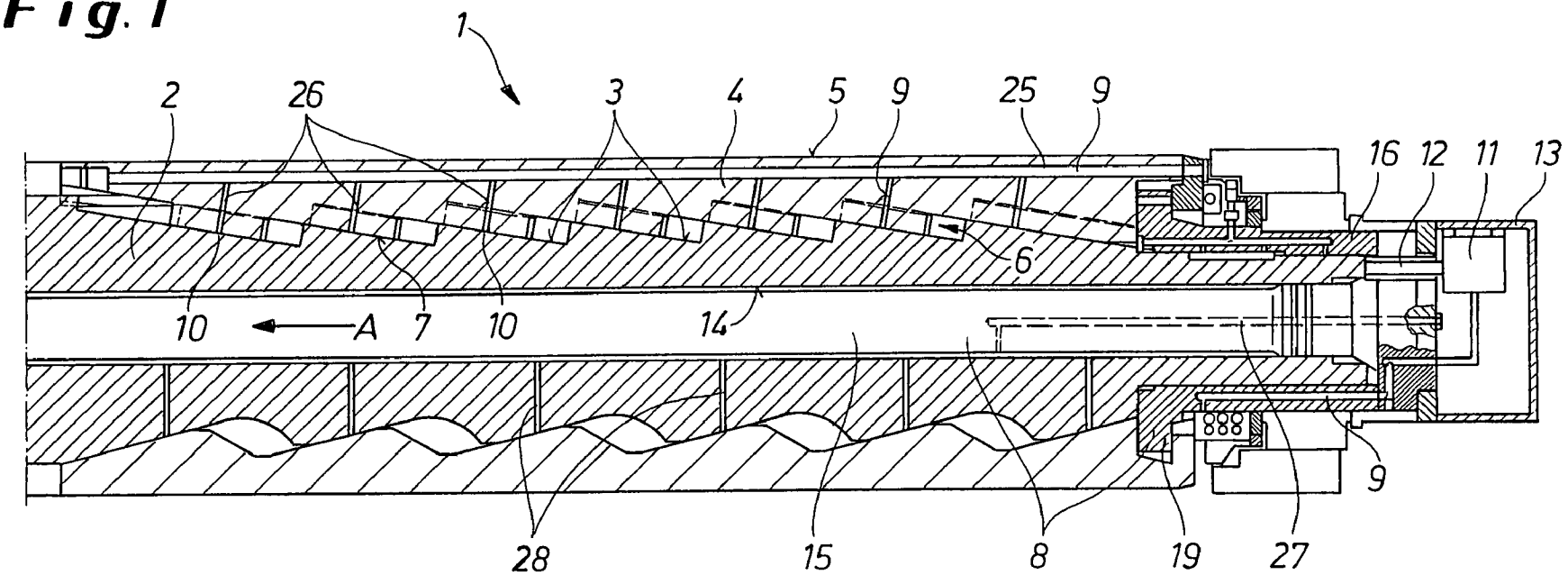
FIG. 1 shows a sectional drawing of an expandable coiler mandrel in a side view.
Figure 2:
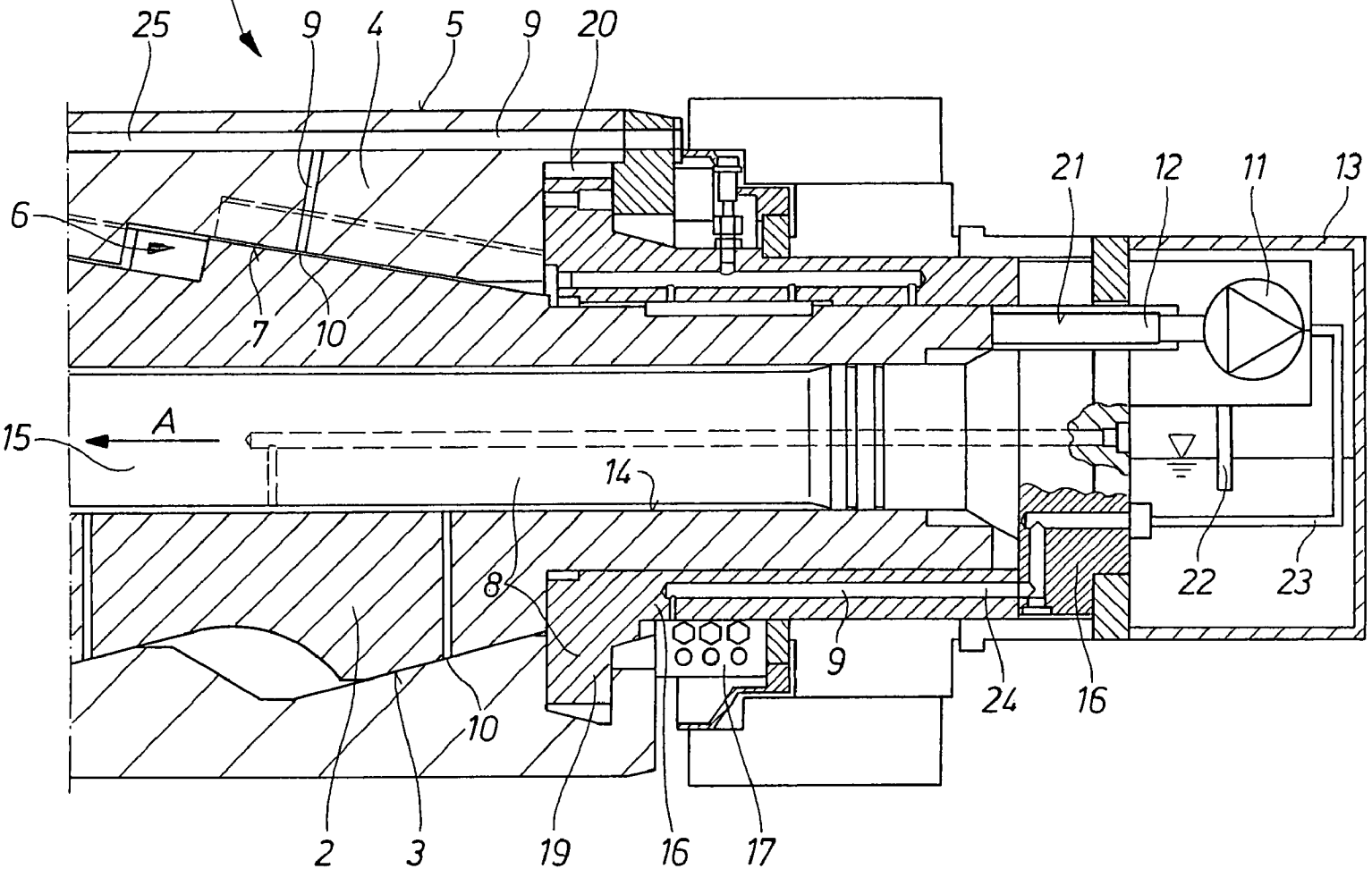
FIG. 2 shows an enlarged view of the right axial end region of the coiler mandrel illustrated in FIG. 1.

As is immediately apparent from FIGS. 1 and 2, this means that, when the segments 4 shift relative to the coiler mandrel shaft 2 in the axial direction A, the segments 4 expand, i.e., are shifted outward, or the segments 4 contract.

This axial shift of the segments 4 relative to the coiler mandrel shaft 2 is accomplished by means 8, which include a connecting rod 15 arranged in a central bore 14 of the coiler mandrel shaft 2. The connecting rod 15 is bolted at one of its axial ends with a pressure plate 16. When the connecting rod 15 moves in axial direction A in the central bore 14, the pressure plate 16 moves with it. The pressure plate 16 has a radially outwardly extending actuating part 19 that mates with a recess 20 in the segments 4. This causes the segments 4 to move along with the connecting rod 15 by the shift amount of the connecting rod 15 in the axial direction.

The contact surfaces of the wedge surfaces 3 and 7 are sites 10 which must be supplied with lubricating grease for good operation of the coiler mandrel 1 during expansion or contraction. Therefore, lubricating grease is fed to these lubricating points 10 via a supply system 9 during the expansion and contraction of the coiler mandrel 1.

This is accomplished by means of a lubricant pump 11, which is installed in a lubricant reservoir 13, which is bolted on in the axial end region of the coiler mandrel 1. The pump 11 and reservoir 13 are installed in such a way that they are rigidly connected with the pressure plate 16.

The pressure plate 16 has a bore 21, in which an actuating element 12 for the lubricant pump 11 is installed. The axis of the bore is oriented in axial direction A. In addition, one of the axial ends of the pin-shaped actuating element 12 rests against the axial end of the coiler mandrel shaft 2.

This means that, during the relative axial shift between the coiler mandrel shaft 2 and segments 4, together with the pressure plate 16 and lubricant pump 11 with lubricant reservoir 13, the actuating element 12 resting against the coiler mandrel shaft 2 is also shifted, and in this way the pump 11 is activated and thus conveys grease from the reservoir 13 into the supply system 9. This conveyance occurs exclusively during the relation movement of the parts 2 and 4, 16, and 11, so that the lubricating points 10 are supplied with lubricating grease only then. Exactly the correct amount of grease is thus supplied to the points 10. Neither insufficient lubrication nor excessive lubrication occurs. The delivery capacity of the lubricant pump 11 can be selected accordingly. During the pumping operation, the pump 11 first draws in the lubricating grease in the lubricant reservoir 13 through an intake pipe 22 and then delivers it to a first lubricant distributor 17 through line 23 and line 24. The first lubricant distributor 17 distributes the volume of grease to four paths, which lead to a total of four second lubricant distributors 18, each of which is assigned to a segment 4. From each second lubricant distributor 18, the lubricating grease enters a distribution bore 25. Each segment 4 has a distribution bore 25. As is best seen in FIG. 1, feeder lines 26 to the individual lubricating points 10 to be lubricated branch off from the distribution bore 25.

Lubricating grease can also be conveyed in similar fashion to the lubricating sites 10 through a line 27 in the coiler mandrel shaft 2 and feeder lines 28.

Due to the design of the lubrication system, the coiler mandrel 1 lubricates itself automatically, depending on the frequency of movement of the mandrel with respect to expansion or contraction. External connections by means of a rotary distributor or an external medium coupling, possibly with electrical position monitoring by limit switches, is not necessary. The high grease pressure necessary for long line lengths and many lubricating points can be developed as high as necessary, which can be determined by the design or choice of the pump 11.

The lubricating grease can be independently supplied in minimal amounts per lubricating point without external supply devices. The type of grease is determined by experts in this field according to the requirements of the particular coiler mandrel.

It is also advantageous that the lubricant reservoir 13, together with the pump 11, can be retrofitted in existing systems. This presents an inexpensive possibility of lubricating the moving parts with minimal amounts. With a constant grease film at the lubricating points 10, the coefficient of friction and thus the internal resistance of the coiler mandrel 1 are maintained at constant levels. A change due to insufficient lubrication and thus the danger of self-locking of the mandrel are thus avoided. Precisely in the case of coiler mandrels whose segments adjustably bear the load of coil weight and strip pressing via wedge surfaces, the coiler mandrels require an almost constant coefficient of friction, which can be guaranteed only by permanent lubrication during movement.

LIST OF REFERENCE NUMBERS

1 coiler mandrel
2 coiler mandrel shaft
3 wedge surface
4 segment
5 coiling surface
6 end region
7 opposing wedge surface
8 means for shifting the segments
9 lubricant supply system
10 lubricating point
11 lubricant pump
12 actuating element
13 lubricant reservoir
14 central bore
15 connecting rod
16 pressure plate
17 first lubricant distributor
18 second lubricant distributor
19 actuating part
20 recess
21 bore
22 intake pipe
23 line
24 line
25 distribution bore
26 feeder line
27 line
28 feeder line
A axial direction

The invention claimed is:

1. Expandable and contractible coiler mandrel (1), especially for coiling a metal strip, which has:

a rotatably supported coiler mandrel shaft (2), which has at least one wedge surface (3) on its outer circumference;

a number of cooperating segments (4), which have a coiling surface (5), especially for the metal strip, on their outer circumference, and which have at least one opposing wedge surface (7) that cooperates with the wedge surface (3) of the coiler mandrel shaft (2) in their end region (6) facing away from the coiling surface (5);

means (8) for shifting the segments (4) relative to an axial direction (A) of the coiler mandrel shaft (2); and a supply system (9) with which a lubricant, especially lubricating grease, is conveyed to places (10) in the coiler mandrel (1) that require lubrication, wherein the supply system (9) is connected with a lubricant pump (11), which has an actuating element (12) for carrying out the pumping operation, such that the lubricant pump (11) is connected with the means (8) for shifting the segments (4) or with the coiler mandrel shaft (2), and the actuating element (12) is connected with the other of the coiler mandrel shaft (2) or the means (8) for shifting the segments in such a way that the pumping operation is carried out only when the means (8) for shifting the segments (4) are actuated.

2. Coiler mandrel in accordance with claim 1, wherein the lubricant pump (11) is connected with a lubricant reservoir (13).

3. Coiler mandrel in accordance with claim 2, wherein the lubricant pump (11) is installed inside the lubricant reservoir (13).

4. Coiler mandrel in accordance with claim 2, wherein the lubricant reservoir (13) is installed in the axial end region of the coiler mandrel (1).

5. Coiler mandrel in accordance with claim 1, wherein the lubricant pump (11) is capable of applying a lubricating pressure of at least 150 bars.

6. Coiler mandrel in accordance with claim 1, wherein the actuating element (12) is designed as a pin aligned in the axial direction (A).

7. Coiler mandrel in accordance with claim 1, wherein the means (8) for shifting the segments (4) relative to the coiler mandrel shaft (2) have a connecting rod (15) arranged in a central bore (14) of the coiler mandrel shaft (2) and a pressure plate (16) connected with the connecting rod.

8. Coiler mandrel in accordance with claim 6, wherein the pin-shaped actuating element (12) penetrates at least the axial end region of the pressure plate (16) and rests against an axial end of the coiler mandrel shaft (2).

9. Coiler mandrel in accordance with claim 1, wherein at least one lubricant distributor (17, 18), which is installed in the supply system (9) between the lubricant pump (11) and the point (10) to be lubricated, distributes the lubricant in different supply lines to different points (10) to be lubricated.

10. Coiler mandrel in accordance with claim 9, wherein a first lubricant distributor (17) distributes the lubricant from the lubricant pump (11) to each segment (4) and that, in each segment (4), a second lubricant distributor (18) is installed, which conveys the lubricant to each of the contact points (10) of wedge surfaces (3) and opposing wedge surfaces (7).

11. Coiler mandrel in accordance with claim 2, wherein the lubricant pump (11), together with the actuating element (12) and the lubricant reservoir (13), is installed in the coiler mandrel (1) as a retrofitted unit.

* * * * *